US009725208B2

(12) United States Patent
Dols et al.

(10) Patent No.: US 9,725,208 B2
(45) Date of Patent: Aug. 8, 2017

(54) CONTAINER ASSEMBLY HAVING STACKING PROVISIONS

(75) Inventors: Merijn Dols, The Hague (NL); Alexander Josephus Maricus Van Puijenbroek, Wageningen (NL); John Boyet Stevens, Zoetermeer (NL)

(73) Assignee: N.V. NUTRICIA, Zoetermeer (NL)

( * ) Notice: Subject to any disclaimer, the term of this patent is extended or adjusted under 35 U.S.C. 154(b) by 0 days.

(21) Appl. No.: 13/279,722

(22) Filed: Oct. 24, 2011

(65) Prior Publication Data

US 2012/0061413 A1 Mar. 15, 2012

Related U.S. Application Data

(63) Continuation-in-part of application No. PCT/NL2010/050220, filed on Apr. 23, 2010, and a continuation-in-part of application No. 13/139,888, filed as application No. PCT/NL2009/050766 on Dec. 15, 2009, now abandoned.

(30) Foreign Application Priority Data

Apr. 24, 2009 (EP) ..... 09158690

(51) Int. Cl.
*B65D 1/40* (2006.01)
*B65D 21/02* (2006.01)
*B65D 43/16* (2006.01)

(52) U.S. Cl.
CPC ..... *B65D 21/0223* (2013.01); *B65D 43/169* (2013.01); *B65D 2543/00027* (2013.01)

(58) Field of Classification Search
USPC ... 220/735, 254.3, 254.4, 254.7, 254.1, 810; 206/503
See application file for complete search history.

(56) References Cited

U.S. PATENT DOCUMENTS

| | | | | |
|---|---|---|---|---|
| 3,338,468 A * | 8/1967 | Wilson | ..... | 206/508 |
| 4,284,200 A | 8/1981 | Bush et al. | | |
| 4,286,713 A * | 9/1981 | Marchais | ..... | 206/508 |
| 5,219,087 A * | 6/1993 | Christensson | ..... | 220/270 |
| 5,657,894 A | 8/1997 | Bowen | | |

(Continued)

FOREIGN PATENT DOCUMENTS

| | | |
|---|---|---|
| BE | 498 744 A | 2/1951 |
| DE | 299 06 577 U1 | 7/1999 |

(Continued)

OTHER PUBLICATIONS

International Search Report, dated Oct. 5 15, 2010, from corresponding PCT application.

*Primary Examiner* — Jeffrey Allen
(74) *Attorney, Agent, or Firm* — Young & Thompson

(57) ABSTRACT

The invention relates to a container assembly comprising a container part with a circumferential wall and a bottom wall, and a lid part comprising a connection portion for connection to a rim of said circumferential wall and a lid which is pivotably connected to said connection portion, said connection portion comprising an upper wall provided with an access opening which can be sealed with said lid, and said connection portion is provided with stacking provisions which enclose said access opening and which are complementary with stacking provisions at the bottom of said container part.

25 Claims, 5 Drawing Sheets

(56) References Cited

U.S. PATENT DOCUMENTS

| | | | | |
|---|---|---|---|---|
| 5,718,353 | A * | 2/1998 | Kanfer et al. | 221/63 |
| 5,958,531 | A * | 9/1999 | Stevenson | 428/35.8 |
| 6,068,153 | A * | 5/2000 | Young et al. | 220/254.3 |
| 6,371,364 | B1 * | 4/2002 | Maillot et al. | 229/114 |
| 6,761,279 | B1 | 7/2004 | Martin et al. | |
| 6,889,867 | B1 | 5/2005 | Smith | |
| 2005/0087543 | A1 | 4/2005 | Smith | |
| 2005/0279727 | A1 * | 12/2005 | Graswald et al. | 215/237 |
| 2006/0156811 | A1 | 7/2006 | Borowski et al. | |
| 2007/0199949 | A1 * | 8/2007 | Simkins | 221/63 |
| 2007/0284276 | A1 * | 12/2007 | Luttik et al. | 206/508 |
| 2008/0041861 | A1 * | 2/2008 | Crawford et al. | 220/697 |

FOREIGN PATENT DOCUMENTS

| | | | |
|---|---|---|---|
| EP | 0 955 247 | A1 | 11/1999 |
| EP | 1 625 948 | A1 | 2/2006 |
| FR | 2 814 719 | A1 | 4/2002 |
| JP | 2004 001815 | A | 1/2004 |
| JP | 2006 282199 | A | 10/2006 |
| WO | 98/09881 | A1 | 3/1998 |
| WO | 03/002416 | A2 | 1/2003 |
| WO | 2005/075314 | A2 | 8/2005 |
| WO | 2007/142522 | A2 | 12/2007 |
| WO | 2008/034172 | A1 | 3/2008 |
| WO | 2010/071404 | A1 | 6/2010 |

* cited by examiner

CONTAINER ASSEMBLY HAVING STACKING PROVISIONS

CROSS REFERENCE TO RELATED APPLICATIONS

This application is a continuation of International Application No. PCT/NL2010/050220, dated Apr. 23, 2010, which claims the priority of European Application No. 09158690.9, dated Apr. 24, 2009, and this application is also a continuation-in-part of U.S. application Ser. No. 13/139,888, filed on Sep. 8, 2011, which is the 35 USC 371 National Stage of International Application No. PCT/NL2009/050766, filed on Dec. 15, 2009.

BACKGROUND

The present invention relates to a container assembly.

WO2007/142522 from the current applicant discloses a such a lid part. In the container assembly disclosed in that application, a container part has a circumferential wall which can be made substantially from cardboard coated with a material for sealing the circumferential wall from the contents of the container, and a lid part attached to a rim of the container part. Applicant uses the container for baby food powder milk. The lid part has a connection portion and a lid which is hingedly or pivotably coupled to the connection portion. The lid rests on the connection portion. The closing of the lid on the connection portion can be improved.

WO2008/034172 discloses a resealable flexible container lid with pivotable second portion. The second portion closes around a rim surrounding an opening of the container. The disclosure calls it "hoop tension". The rim forms an integrally formed part of the container wall. The second portion should pivot around, or flip up with respect to, a first portion connected to the lid. This may require an almost rubbery behaviour. This construction puts a burden on the lid, in particular when frequent opening and closing is required whilst maintaining a good sealing. Furthermore, the lid is not coupled to a further part via a hinge.

EP-1.625.948 discloses a packaging for liquid paint which has a plastic wall with an integrally formed peripheral flange. It has a plastic lid having a wall with groove for receiving the flange and an inward circumferential ledge locking under said peripheral flange, providing a snap-action. The lid is not pivotably connected to the rest of the packaging.

JP-2004-001815 discloses a plastic container having a separate lid. The disclosed embodiments have several interlocking rims and circumferential projections and corresponding recesses which make these lids too cumbersome to open in daily use.

JP-2006-282199 discloses a container for powdered milk, for instance. The container has a separate lid. This lid has a second, circumferential, skirt attached to the outer wall of the container and a first, circumferential, skirt connected to the lid. A circumferential, removable, band connects the first and second skirt. The first skirt has an inward projection hooking behind a circumferential projection part on the outside of the container wall.

U.S. Pat. No. 6,889,867, also published as application US 2005/087543, discloses a plastic container which comprises a lid with a closing flap for sealingly closing the container for preventing moisture loss, i.e. moisture leaving the container. The lid is placed over the rest of the container and rotated resulting in mating threads. Sealing of the lid on the rest of the container is achieved using a ridge. The lid further has a relatively small, circular dispensing port having a wall with slots through which cleaning wipes can pass and leave the container. The dispensing port has a circumferential wall for sealingly receiving a circumferential wall of the closing flap. The lid is designed to keep moisture inside the container. To that end, the opening is round and is kept as small as possible. The location of the closing flap with respect to the rest of the lid makes the closing flap difficult to open.

U.S. Pat. No. 4,284,200 discloses a child-resistant dispensing closing. The lid has a rim and the opening is surrounded by a rim. Both rims have an extending lip such the lid snaps the opening surrounding rim. The lid has an ear which is closely spaced to a fulcrum such that a pry-means is needed to pry off the lid, thus providing a child-resistant closure. The lid is difficult to open without aids.

U.S. Pat. No. 6,761,279 discloses a package for viscous foodstuff. The package has a container and a closure fitting onto the container. The closure has a base and a lid. The base has specific provisions for cooperating with provisions on the container for attaching the base to the container in such a way that the rim of the container is left free for sealing a seal membrane on the rim. The attachment provisions make this package relatively complex. In order to sealingly close the packaging, the lid has a circumferential pocket for receiving a rim on the base. The opening of the closure matches the mouth of the container. It was found, however, that the lid does not sufficiently seal on the rim. The sealing of the lid leaves room for improvement, in particular in view of production costs. Furthermore, stacking these packages may jeopardize the sealing of the lid. Finally, the container needs to have closure support in the form of an additional upstanding wall part circumferential to the mouth for receiving the base of the closure. This construction limits the design and choice of wall material of the container. Furthermore, stacking packages may jeopardize the sealing of the lid.

SUMMARY OF THE INVENTION

The invention aims to improve the closure of a container assembly. A further or alternative aim is to provide a closure which is easy to open and close in daily use.

Another of further object of the invention is to provide a container assembly which produces minimal wast.

According to the invention this is realized with a container assembly comprising a container part with a circumferential wall and a bottom wall, and a lid part comprising a connection portion for connection to a rim of said circumferential wall and a lid which is pivotably connected to said connection portion, said connection portion comprising an upper wall provided with an access opening which can be sealed with said lid, and said connection portion is provided with stacking provisions which are provided around said access opening and which are complementary with stacking provisions at the bottom of said container part.

The invention furthermore provides a lid part for a container assembly, said lid part comprising a connection portion for connection to a rim of a container part and a lid which is pivotably connected to said connection portion, said connection portion comprising a circumferential U-shaped rim for receiving an upper edge of a side wall of a container part, wherein an inner wall of said U-shaped rim comprises reinforcement ribs extending beyond the legs of said U-shaped rim, and said connection portion comprising a circumferential abutment surface bordering an upper surface of said lid part, said reinforcement ribs and said abutment surface mutually positioned such that when said lid part is stacked on a second said lid part, extending lower ends of said reinforcement ribs rest on said circumferential abutment surface of said second lid part while keeping the legs of said U-shaped rim of said lid part free from said circumferential abutment surface of said second said lid part.

The inventions described in this document all relate to improving the closure of a container. In fact, they all relate to improving the reliability of this closure. In this invention, stacking provisions are provided in such a way that they are placed around the lid when it seals the access opening. The stacking provisions on the connection portion are thus arranged around the access opening, and in this way, when container assemblies are stacked on t of one another, they do not load the lid with forces which may compromise the sealing. As the containers are often used for milk powder for instance babies and infants, it is very important that the container assembly is sealed and remains sealed. When stacking containers onto each other during transport or at a point of sales, the bottom of one container may shift a little on the upper part of the lid part of a lower container. Thus, it can press against the lid. This may cause a lid to yield a little. In case of a container for food products, and in particular infant nutrition, for instance insects may thus get into a packaging.

In an embodiment, said lid part has a weight of about 5-500 gr. In an embodiment, the weight is between 5 and 100 gr., specifically between 5 and 20 gr.

In an embodiment, said stacking provisions on said connection portion comprise cams. These cams can be produced in an easy way, for instance as extended wall parts. Alternatively, one or more rims may be provided around the access opening. Such rims are positioned in such a way that they allow opening and access to the lid for opening and closing.

In an embodiment, said cams are positioned at corners of a (virtual) rectangle which encloses said lid when sealing said access opening. In positioning the stacking provisions on the connection part in this way, rotation-free stacking can be made possible.

In an embodiment, the height of said cams is at least the height of said lid when sealing said access opening. In fact, when the stacking provisions on the connection part are at least as high as the lid, they prevent the bottom of a next container assembly stacked on top of this container assembly from even touching the lid.

In an embodiment, said connection portion comprises a circumferential rim for receiving an upper edge of a side wall of said container part in a groove, the inner perimeter of said rim being complementary to the perimeter enclosing said stacking provisions of said lid part for providing complementary stacking means for stacking a series of lid parts. Thus, the stacking provisions on the connection part have a function during production, i.e. keeping lid parts stacked and positioned, and afterwards in keeping container assemblies securely stacked without loading the lids.

In an embodiment of the lid with U-shaped rim, said abutment surface is connected to said U-shaped rim and defines an access opening which is closed by said lid.

According to a further aspect of the invention, which may also form an embodiment of the invention as described above, this is realized with a lid part for a container, said lid part substantially made from a thermoplastic material and comprising a connection portion for connection to a rim of a container part and a lid which is pivotably connected to said connection portion, said connection portion comprising an access opening and a circumferential first flange surrounding said access opening, said lid comprising a circumferential lid flange extending towards said connection portion, perimeters of said lid flange and of first flange mutually adapted to allow said lid to close in a sealing manner on said first flange of said connection portion, and an area of said access opening is at least about 50 $cm^2$.

In one embodiment the present invention related to a packaging for powdered infant nutrition. In such packaging, it is important that foreign objects do not enter into the packaging and contaminate the powder. On the other hand the packaging needs to be opened repetitively.

Powdered baby milk formula is normally retrieved from the container using a metering spoon. The metering spoon is often included in the packaging. Hence, to be able to properly retrieve powder from the container, the access opening should be as large as possible.

All these demands seem to be difficult to bring together in one single container. For example, the easiest way of providing a good sealing of the contents, however, is to make the access opening as small as possible. Additionally, a better sealing is usually achieve with (semi-) permanent closure means.

The lid part of the invention, however, makes it possible. The present invention provides a lid part for a container with an access opening that is sufficiently big so that the contents (e.g. powder) can be scoped out of the container, while having a sealing which effectively reduces entrance of foreign objects. It was surprisingly found that the present lid part with a big access opening could be repetitively closed while maintaining a good sealing.

The lid part of the current invention provides a good sealing which prevents foreign objects from getting into a container which it covers. And yet, the lid of the lid parts needs to be opened and closed frequently more times a day, and provide a good sealing after frequent use. Preferably, the sealing is achieved in an easy way. In fact, it was found that in an embodiment, about 2-5 N for opening force would be acceptable. For closing force, in an embodiment a force of about 6-15 N would be acceptable.

As the container it covers needs to be disposable, it preferably is cheap to produce in large quantities and provide minimal wast. Furthermore, it would be beneficial if the lid part is easy to handle in production as well as in production of a complete container. Additionally, a good sealing is particularly desired if the content of the packaging is hygroscopic. A better closure will reduce the exchange of air (with high water content) between inside and outside the packaging, thereby reducing the formation of lumps in hygroscopic material, e.g. baby milk powder. Hence, the present invention is particularly useful for storage of baby milk powder in an environment with a tropical climate.

The lid part of the invention can be used for containers with for instance a cardboard wall, but is not limited to such a use. Usually, such a cardboard wall is covered or coated with one or more sealing layers for sealing contents of the container from environmental influences. An example of such a packaging is disclosed in WO2005075314 and WO2007142522 of applicant. For jurisdictions in which this is meaningful, these documents are incorporated by reference as if fully set forth in this document.

The lid part is particularly suited is use with a container for storing powder. In fact, it is well suited for storing hygroscopic powder, in particular food products like baby milk. The manual opening and closure preferably requires a very limited effort and/or strength. Preferably, the lid can be opened manually with one hand. This is particularly relevant for packaging of baby milk powder, as the mother preferably is able to open and close the pack while carrying the baby.

In order to avoid a hand coming into intense contact with the contents, the lid is preferably provided with clamping provisions for clamping and holding the metering spoon of scoop. This further limits the choice of dimensions.

The dimensions of the stem of such a spoon are therefore limited. On the other hand, this may also limit the dimensions of the packaging container. The stem of the spoon in an embodiment is long enough to enable a person to reach the bottom of the container.

In an embodiment, said circumferential first flange has a first perimeter near said connection portion and a second perimeter near the rim of said flange at an end of said flange away from said connection portion, said second perimeter of circumferential first flange is larger than its first perimeter, and said lid has a first internal perimeter near said lid and a second internal perimeter near the rim of said lid flange, said second, internal perimeter of said lid is smaller than said first perimeter near the rim of said lid flange, said perimeters of said lid flange and of first flange mutually adapted to allow said lid to close in a sealing manner on said first flange of said connection portion with its lid flange surrounding said first flange. This allows easy closing and opening, especially for a daily use. Furthermore, by sealing the lid flange around the first flange, it is easier to free the lid part after moulding.

The first flange on the connection portion together with the lid flange in an embodiment provide a snap locking seal. The corresponding lid flange (seal bead on the lid) thus interlocks with the other, first flange such that proper seal interference. This seal interference can provide suitable seal pressure to prevent moist air from entering or exiting the container or it may be implemented so as to guarantee a maximum gap small enough to prevent the entry of foreign objects in the container. These features also allow for providing seal performance using conventional engineering plastics and may help to avoid additional cost of bi-injected elastomeric materials.

Further, in a embodiment the flange and lid flange, which may also be referred to as chimney and snap bead features, respectively, could be interchanged to affect the same mechanism and/or two "chimney" features could be used instead. Note that the chimney feature may have similar curvature on the inside and outside wall, which allows it to be injection moulded such that the feature can be stripped from the mould without special floating cores and therefore allows for faster cooling, lower cycle time and therefore lower cost. Further the arrangement of these seal features allows for a robust snap seal performance for relatively large diameter apertures.

In an embodiment, the container assembly has the connection portion comprises an access opening and a circumferential first flange surrounding said access opening, said lid comprising a circumferential lid flange extending towards said connection portion, perimeters of said lid flange and of first flange mutually adapted to allow said lid to close in a sealing manner on said first flange of said connection portion, said lid is connected to said connection portion via an integrated hinge which has a connection part connecting to the lower end of lid flange. Thus, sealing is not compromised by the connection part.

In a embodiment said lid is further provided with a lip for opening the lid, which opening lip is provided at the lower end said lid flange. This also does not compromise sealing.

Further, the arrangement of the flanges or snap seal features can be tuned to allow for sufficient seal performance, suitable opening force and suitable closing force. Also, the retention provided by the snap-seal prevents the lid from opening partially or fully or appearing to be partially open when the package is disturbed by external forces. The specific curvature, angle and undercut geometry of the flanges (chimney and seal bead features) and their assembled interference can be tuned to vary the seal pressure, opening and closing force as may be required.

In an embodiment, the area of the access opening is at least about 60 $cm^2$. This allows an even better access of a hand. In an embodiment, the area of the access opening is at least about 75 $cm^2$.

In an embodiment, the area of the access opening is less than about 250 $cm^2$. Thus, it is possible to provide an easy access for an adult hand, and still allow the lid to be closed sealingly in a simple action. In an embodiment, the area of the access opening is less than about 200 $cm^2$. These upper and lower limits provide a good trade off between easy access for a human hand, sufficient stiffness, a good closure, and the possibility of providing a scoop or spoon which can be held in the lid and reach the bottom of a container assembly.

In an embodiment of the invention, said first flange bounds said access opening. This can further increase rigidity to the lid part.

In an embodiment, said first flange fans or flares out away from said access opening, thus increasing a perimeter of said first flange.

In an embodiment, said circumferential first flange circumferentially at its outer periphery thickens near or at said rim of said first flange. Alternatively, or additionally, the inner periphery of the lid flange thickens near or at said rim.

In an embodiment, said second internal perimeter of said lid flange is about 2-7% smaller than said first perimeter of said connection portion. Especially when made from a thermoplastic material, it was found that this provide a good sealing, but remained easy enough to open.

In an embodiment, said access opening is substantially round or substantially elliptic. This will in most cases provide a moisture-tight sealing. In some applications, even a rectangular opening with rounded corners might be acceptable with respect to degree of sealing. These shapes allows a good sealing. In order to provide a moisture proof sealing for hygroscopic powders, it is preferred if large (in view of the dimensions discussed) straight parts are avoided in the access opening or first flange and the lid.

In an embodiment, an area of said access opening is at least 50% of the area of the connection portion. This allows enough room to allow a hand to pass with a scoop to retrieve the contents. On the other hand, it allows proper sealing, and allows a suitable scoop or spoon to be clamped inside the lid.

In an embodiment, an area of said access opening is about 60-70% of the area of the connection portion. This seems to be a proper trade off.

In an embodiment, an inner diameter of the access opening is at least 9-13 cm. In an embodiment a diameter of the connection portion is at least 10-13 cm. These dimensions provide good sealing and sufficient contents of the container In an embodiment, the cross section of said container part is about rectangular. Furthermore, the access opening has no straight parts. In an embodiment, the access opening is round or elliptic. The round or elliptic access opening provides good sealing. The rectangular cross section of the container part allows little loss in transport space. This however requires a wall connecting connection portion and access opening.

In an embodiment, said lid flange is of a thermoplastic material allowing its perimeters to expand when placing said lid on said first flange, and wherein said first and second perimeter of said lid flange, if said lid is not closing said opening, is smaller than the perimeters of said first flange.

In an embodiment, said the thickness of said first flange in view of its thermoplastic material is selected to provide a stiff flange.

In an embodiment, said lid part is made of a thermoplastic polymer selected from the group consisting of polyethylene (PE) and polypropylene (PP). These materials are easy to obtain and to process. Furthermore, these materials provide a amount of flexibility and elasticity which allows a good sealing and daily use. If desired, some of the parts of the lid part may be from a more elastic, rubbery material in a co-moulding process. A lid flange closing around the first flange may for instance be moulded from a more elastic polymer material, which material as such is known in the art. Alternatively, an end part of the first flange may be made from a more elastic, rubbery material. This may be produced in a co-moulding process.

In an embodiment, said lid is of a thermoplastic material having a elasticity such that it allows hermetic sealing of said lid on said connection portion via said lid flange on said first flange.

In an embodiment, said connection portion comprises a wall provided with said access opening, and said first flange extends from said wall, said wall and said lid when closing said access opening provide closure for a top of said container part.

In an embodiment, said connection portion comprises a circumferential rim which has a circumferential groove for receiving said rim of said container part. In an embodiment, a circumscribed area of said circumferential rim is larger than the area of the access opening.

The invention further pertains to a container comprising a container part having a bottom and a circumferential side wall connected to said bottom and having a circumferential edge, and a lid part according to any one of the preceding claims, said groove of said U-shaped rim receiving said circumferential edge.

The various aspects discussed in this patent can be combined in order to provide additional advantages. Several aspects described in this description or in the claims may form part of a divisional application.

DESCRIPTION OF THE DRAWINGS

The invention will be further elucidated referring to an embodiment of a lid part and a container assembly using this lid part shown in the attached drawings, showing in.

DETAILED DESCRIPTION OF EMBODIMENTS

Figure 1:
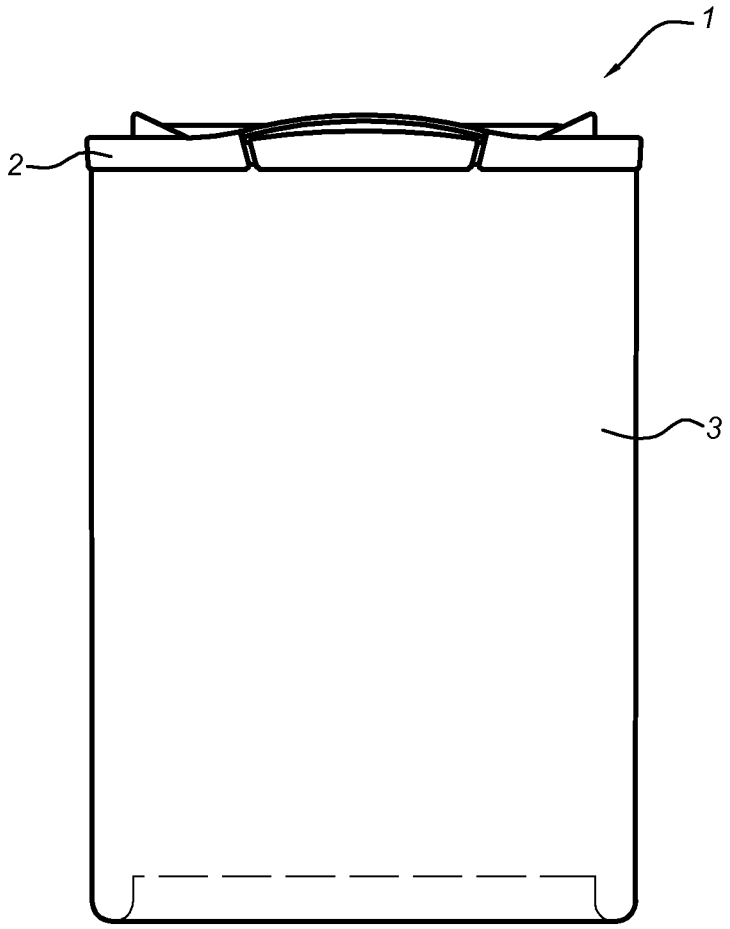
FIG. 1 use of the lid part on a container assembly.

In FIG. 1, a container assembly 1 with a lid part 2 of the invention is presented. The container has a container part 3. The container part 3 can be made of cardboard, coated with a synthetic coating layer known in the art for making it suitable for containing food or liquids. The container part can also be made of plastic or metal. Preferably, it is used for holding food or liquids. The container part can also be made of plastic or metal. Preferably, it is used for holding food or liquids. In an embodiment, the container part 3 can have a synthetic coating layer on its inner surface, and a sealing foil of sealing membrane is attached below the rim or edge of the container part 3, in an embodiment about 1-3 cm below the edge. The sealing foil can be attached to the inner surface of the container part 3, for instance through heat sealing. Thus, some space can be provided between the lid and the seal for storing for instance a measuring scoop or spoon.

Figure 2:
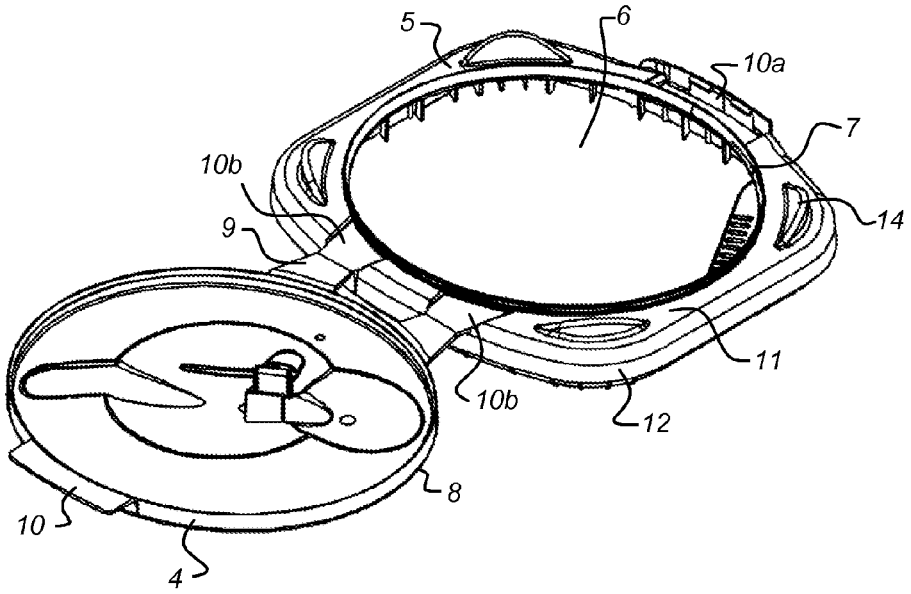
FIG. 2 a perspective top view on a lid part with open lid.
Figure 3:
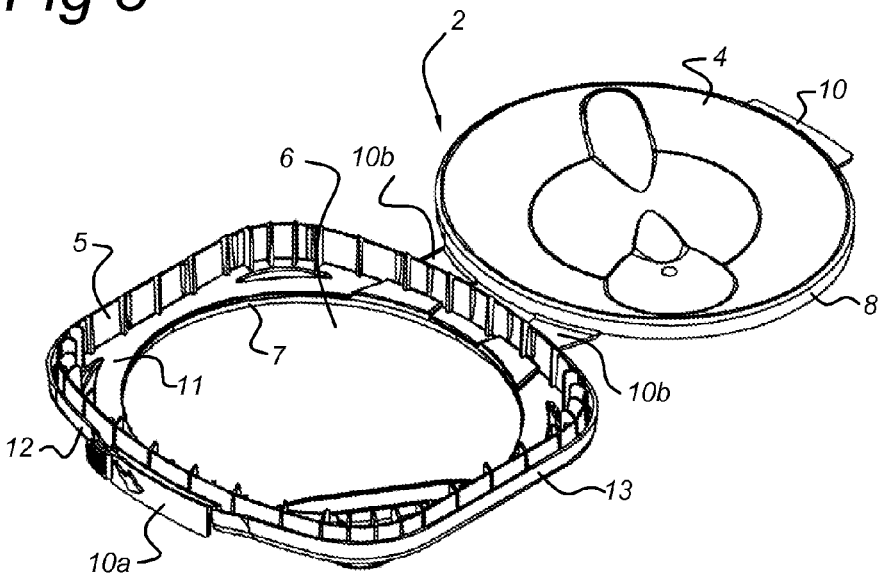
FIG. 3 a perspective view of FIG. 2 from below.

Lid part 2 is further elaborated in FIGS. 2 and 3, showing a 3D view of the lid part 2 with opened lid 4 from above (FIG. 2) and from below (FIG. 3). Lid part 2 comprises a connection portion 5, a (living) hinge 9 and a lid 4. Lid 4 is thus pivotably connected to connection portion 5. Connection portion 5 defines an access opening 6. In this embodiment, a first flange 7 bounds the access opening 6. Lid 4 is provided with a lid flange 8 which fits on the first flange 7 to close off access opening 6 and to hermetically seal a container assembly 1. In this embodiment, the access opening is almost elliptic. The access opening 6 can also be round. Alternatively, it can be rectangular with rounded corners. Important in all there embodiments, however, is that the lid flange 8 fits around the flange 7 to hermetically seal the access opening 6.

In order to provide a lid part 2 with a lid 4 which can be opened easily, the hinge 9 has a connection part connecting to the lower end of lid flange 8. Thus, the entire lid 4 can remain accessible for engaging it for opening lid 4. Furthermore lid 4 is provided with a lip 10 for opening the lid 4 easily. In this embodiment, the lip 10 is also provided at the lower end of lid flange 8. Here, it is provided opposite the hinge 9. Thus, a uses can engage the lip 10 to open lid 4 easily. The lip 10 further provides an end rim which can be covered or shielded with a tamper evidence lip 10*a*.

Connection portion 5 further comprises a wall 11 which is provided with said access opening 6. On the wall 11, cam elements 14 are provided. The use of such cams 14 are further explained in WO2007142522 of the current applicant. These cams 14 provide part of stacking means for stacking lid parts in production. Furthermore, these cams 14 provide part of stacking means for stacking complete container assemblies for instance in stores. In this embodiment, the cams 14 are provided on the connection portion 5. An advantage of this is that the lid 4 is not loaded. Thus, the quality of closure is can not be compromised. Yet, the height of the lid 4 in closed position is equal or substantially equal to the height of the cams 14. Thus, when container assemblies are stacked, the load of the containers will keep the lids pressed close, while preventing loads from other directions. Especially with a lid 4 which fits clampingly on the flange 7 according to an aspect of the invention, the stacking means 14 further secure the closing of the lid 4.

It was already discussed that hinge 9 has a connection part connecting to the lower end of lid flange 8. In fact, in order not to compromise the sealing property of the lid 4, the connection part of hinge 9 connects below the circumferential lower end of lid flange 8. Thus, the sealing properties of the lid 4 on flange 7 is not compromised at all. This, however, also required a lowered part 10*b* in wall 11. Thus, the sealing properties of lid 4 on connection portion 5 are not compromised at all. This sealing can be improved even further by connecting opening lip 10 also below the circumferential lower end of lid flange 8. Again, to provide an even improved sealing, the wall 11 should also have a corresponding lowered part 10*c* in wall 11. In FIG. 2 this is clearly indicated. As the wall 11 is relatively thin in the embodiment shown, this means that wall 11 will be offset towards the inside of the container. This can be seem in FIG. 3.

Connection portion 5 is further provided with a circumferential rim 12, which may be called a U-shaped rim. It has a groove 13 to receive an upper edge of the side wall of the container part 3. Fixation of the connection portion 5 to the container wall can be effected through any means known in the art. In an embodiment, a hot melt adhesive is provided in the groove 13.

Figure 4:
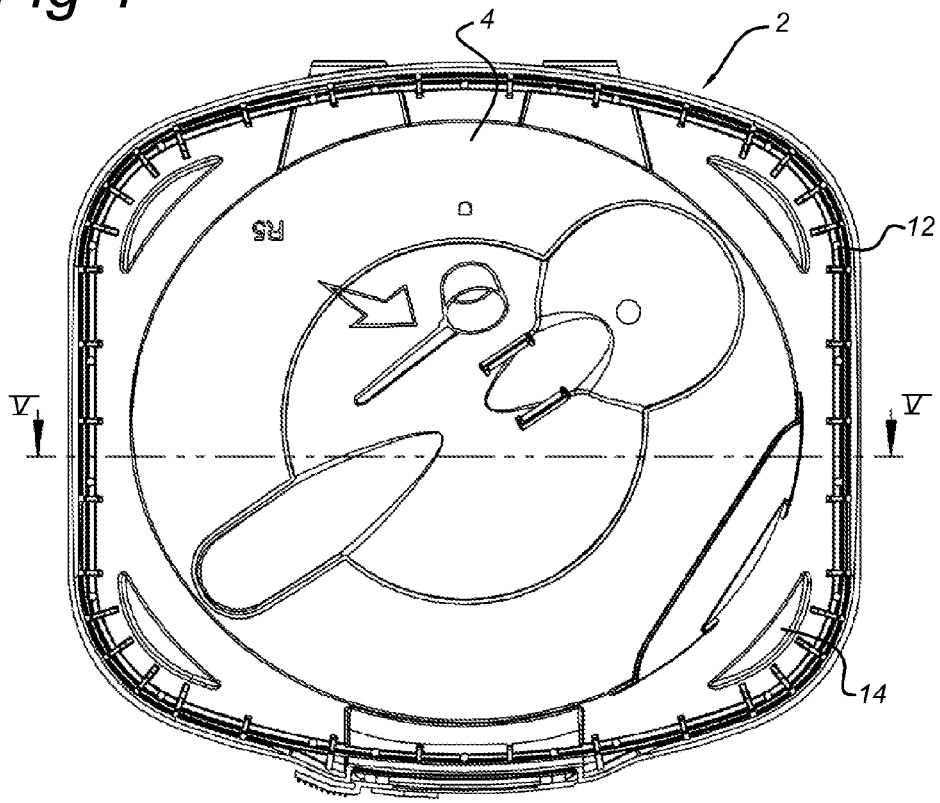
FIG. 4 a bottom view of a lid part with closed lid.
Figure 7:
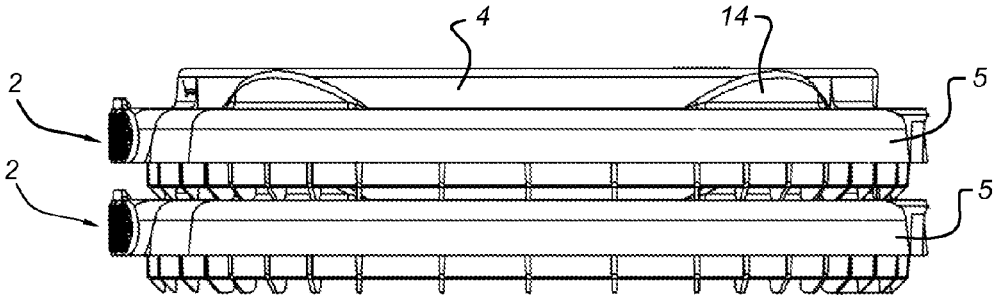
FIG. 7 stacked lid parts.

FIG. 4 shows a view bottom up, of a lid part 2 with closed lid. In this drawing, a cross section is indicated. This cross section is further shown in FIG. 5. This cross section shows more clearly how lid flange 8 of lid 4 closes on flange 7 of the connection portion 5. In FIG. 7, this is shown in more detail.

Figure 5:
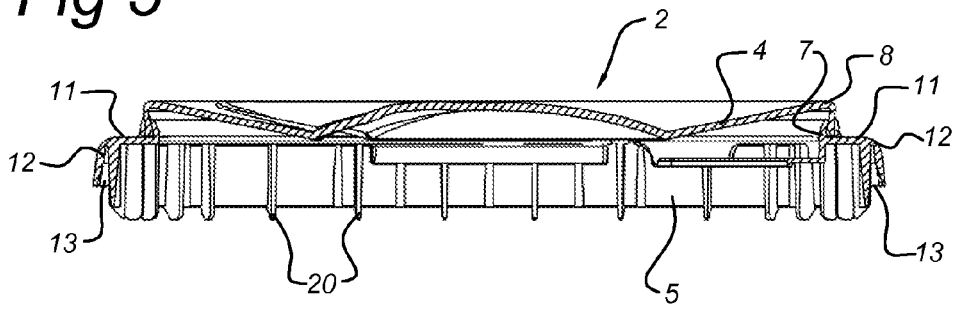
FIG. 5 a cross section as indicated in FIG. 4.

FIG. 5 also shows the connection portion rim 12 more clearly. In the view of FIG. 5, reinforcement ribs 20 indicated which provide additional rigidity to rim 12.

Figure 6:
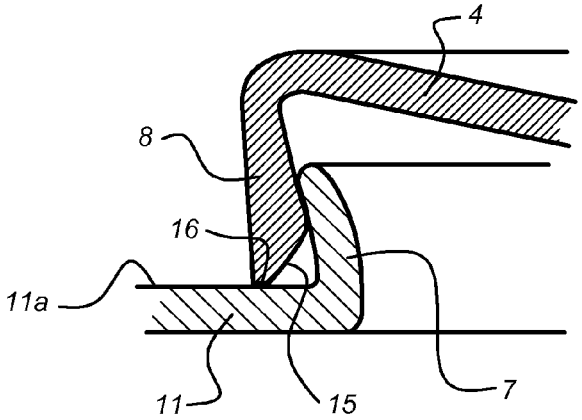
FIG. 6 a detail of a cross section of the lid flange.

FIG. 6 shows a detail of the lid flange 8 closing on the flange 7 of the container part 5. Lid flange 8 fits clampingly around flange 7 of connection portion 5. In the situation of FIG. 7, where the lid is closed on the connection part 5, the perimeter 23 at the edge 15 of flange 7 is identical to the (internal) perimeter of lid flange 8 at position 22. At position 16, the lid flange 8 is thickened. Flange 7 flares out. It is shaped in such a way that its outer circumferential surface fits against the inner circumferential surface of the lid flange 8. The lid flange 8 is made from a thermoplastic material. This allows some degree of elasticity. Especially, here the lid flange has a thickness in view of the elasticity of the used thermoplastic material. The lid flange 8 fits somewhat elastically around the relatively stiff flange 7. In order to close the lid and to make it easy to do this frequently, the lower end of lid flange 8 has a beveled off edge. This makes it easy to flip the edge of lid flange 8 over the edge of flange 7. When not fitted on flange 7, the lid and in particular the lid flange 8 is dimensioned such that the smallest internal perimeter of lid flange is smaller than the smallest (circumscribing or outer) perimeter of the flange 7. Preferably, the outer perimeter of flange 7 at the edge 15 is larger than the inner perimeter of lid flange 8 at position 22. In this way, the lid 4 cannot flip off spontaneously. In an embodiment, the flange 7 flares out. The shape of the lid flange follows this shape or follows it when stretched a little. The lid flange 8 is stretched a little to elastically fit around flange 7. This makes a hermetic sealing possible. In practice, for instance in the embodiment shown in the drawings, the smallest diameter of the flange 7 is 101.89 mm, the largest diameter is 112.65 mm. In an embodiment, the thermoplastic material is polypropylene (PP). In this case, the inner diameters of the lid are for instance 101.36 mm and 112.12 mm. The outer diameters are for instance 104.0 mm and 114.8 mm. For this material, the thinnest part of lid flange 8, D1, can be about 0.7-0.8 mm and the thickest part D2 is about 1.1-1.2 mm. The height of the lid flange is about 3.9-4.5 mm, and the height of a corresponding flange 7 is about 2.9-3.1 mm. In practice, the diameter of the lid flange will be about 3-7% smaller than the corresponding diameter of the flange 7. In practice, the lid flange 8 will taper inwardly a little, with an angle of about 2-5 degrees. Due to its elasticity, the lid flange 8 when closed around the first flange 7, will stretch a little and the lid flange 8 will taper no longer, and fits closely around the first flange 7. In the drawing, the cooperating tapered shapes of the lid flange 8 and the flange 7 pull the lid onto the outer surface of wall 11 of the connection portion in order to provide an additional seal of the edge of the lid flange 8 and the wall surface 11. Furthermore, to improve the sealing even further, the lower end of lid flange 8 can be a little tapered to the outside of lid 4. In this way, due to the elasticity which pulls on the lid, in combination with the selected dimensions, this pulls the lowest circumferential end 16 of lid flange 8 against surface 11*a* of wall 11, thus providing a second sealing. In particular in combination with the hinge 9 connection part and opening lip 10 provided as described above, below the circumferential end 16 of lid flange 16, this improves the sealing.

In order to provide the lid flange 8 with a certain amount of elasticity while on the same time provide a connection portion and in particular its flange 7 with sufficient rigidity, and to allow the lid part to be made cheap and in large quantities, in an embodiment the lid part is made from thermoplastic material. In particular, it is made of polyethylene (PE) or polypropylene (PP). The material in an embodiment is supple and elastic enough to allow the lid flange 8 to be stretched around the flange 7. Thus, an hermetic seal is possible.

In an embodiment, the volume of a container having the lid part is about 0.5-2 liter. This volume is determined by depth, width and height of the container. In order to be able to provide a metering scoop having a length long enough to reach the bottom of the container inside the container, one of dimensions of the diagonal cross section or the width or depth is preferably in the same order of magnitude as the height of the container. Furthermore, it is preferred if the scoop can be clamped to the inside of the lid. In practice, the container may have a depth of about 9-13 cm, a width of about 11-16 cm, and a height of about 10-18 cm. The scoop or spoon will have a total length of about 9-11 cm. The access opening will thus need to have a largest diameter of at least about 9-11 cm, depending on the total length of the spoon or scoop used. The area of the access opening 6 will be at least about 50% of the cross section area of the container fitted with the lid part. An upper limit which can be attained will be about 85%. In the example presented, this number will be about 60-70%. This will allow the lid to be large enough, both in area as well as in maximum diameter. At the same time, it will leave enough room for allowing the stacking cams 14 on the connection portion 5.

A big access opening is preferred for easy entrance with a scope. Furthermore, for hygiene reasons when offering a filled container to the public in a store, the scope can be provided clamped in clamps provided in the inside of the lid or between the lid and the product seal which is additionally provided in the container below the lid (i.e., in the space provided between lid and product seal). In an embodiment, the lid has at least minimal dimensions so as to fit the scope.

Figure 8:
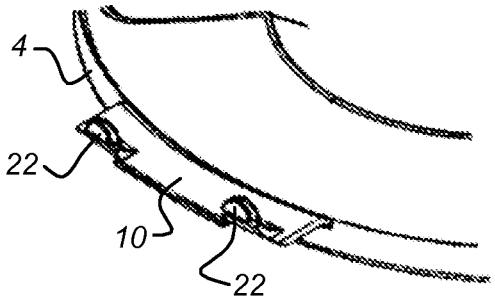
FIG. 8 a detail of an opening lip, and
FIG. 9 a detail of a tamper evidence strip.
Figure 9:
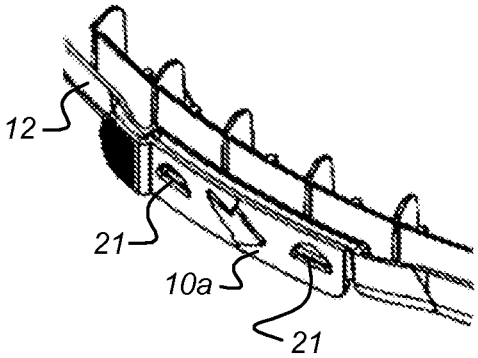

As mentioned before in the discussion of FIGS. 2 and 3, for easy opening the lid 4 comprises an opening lip 10. FIGS. 8 and 9 show an embodiment with further improved tamper evidence functionality. Here opening lip 10 is attached to the rim of lid flange 8. The opening lip 10 is at its edge blocked by tamper evident strip 10*a*. This strip 10*a* has cams gripping the edge of opening lip 10. These cams can be seem in FIG. 2. The strip 10*a* is attached to the connection portion 5 via thin bridges of material. This aspect can for instance be seem in FIG. 4 and in FIG. 9. These bridges should be thin enough to break if strip 10*a* is twisted a little to allow the opening lip 10 pass the cams of strip 10*a*. In another embodiment, to further improve the tamper evidence provision, the opening lip 10 can be provided with at least one blocking end 22 extending in the direction of strip 10*a*. Furthermore, strip 10*a* can be provided with corresponding recesses 21 for receiving at least part of the at least one blocking end. This is shown in FIGS. 8 and 9 in a specific embodiment. In that embodiment, opening lip 10 has two blocking ends which extend radially or substantially radially with respect to the lid 4. Furthermore, in this embodiment the recesses 21 are through holes in strip 10*a*. Thus, when on first time opening of the lid 4, the tamper evidence strip 10*a* will break. Furthermore, the blocking end 22 extending through the holes 21 are a very visible indication for customers. In sensitive products like baby food, thus is an important feature.

FIG. 7 shows two stacked lid parts 2, 2'. The cams 14 on the connections portion 5 provide a secure stacking for defining the position of the lid parts in producing container assemblies, while preventing loading the lid 4. Here, the stacking cams are provided on wall 11. In fact, as is already indicated in FIG. 1, a first use of cams 14 is to provided one part of stacking means which work together with complementary stacking provisions at the lower part of the container part, in particular in the bottom. This allows secure stacking of several containers in top of one another. Furthermore, as the stacking provisions on the lid part are provided on the connection portion around the lid (in closed position), when stacking container assemblies provided with the lid parts, the closure of the lid is not compromised. In fact, in the embodiment shown, the stacking provisions on the lid part extend a little above the lid in order to further secure closure or in order to not compromise closure.

A second use of the stacking provisions on the lid part is possible if the positioning of these stacking provisions is adapted to the dimension of the connection portion. Thus, the effect and use of stacking lid parts described above is realized.

The positioning of the stacking provisions 14 on the connection portion is such that a container assembly stacked on to of the lid part cannot rotate. I.e., it cannot rotate about an axis normal to the access opening. To that end, the cams 14 are in this embodiment provided at corners of a (virtual) rectangle. The complementary stacking provisions at the bottom of the container part provide abutment at sides of the rectangle against the stacking provisions 14 on the lid part 2.

In this embodiment, the stacking provisions on the container part are provided by a circumferential rim at the bottom of the container part as indicated in FIG. 1. The inner diameter of the (dotted) stacking provisions at the bottom match the outer diameter of the stacking means 14. In fact, the shape of the stacking provisions at the bottom will in this embodiment match the (virtual) shape of the stacking means 14 of the lid part 2. In particular, bottom view FIG. 4 of a lid part 2 shows the stacking cams 14 positioned at corners of a rectangle with unequal sides. In an embodiment, the stacking provisions at the bottom of the container will match this shape of the rectangle with unequal sides. In fact, when fitting closely, the stacking cams 14 and stacking provisions at the bottom in their cooperation can stabilise a stack of containers.

It will also be clear that the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A container assembly for a powdered nutritional product, the container assembly comprising:

a container part with a circumferential wall and a bottom wall; and a lid part comprising a connection portion for connection to a rim of said circumferential wall and a lid which is pivotably connected to said connection portion, said connection portion comprising an upper wall provided with an access opening which can be sealed with said lid, and said connection portion is provided with stacking provisions which are provided around said access opening and which are complementary with stacking provisions at the bottom of said container part, wherein said lid part has a weight of between 5 g and 500 g, an area of said access opening is at least 50% of the area of the connection portion, said access opening is surrounded by a circumferential first flange and said lid comprises a central portion having an underside including a clamp for holding a metering scoop for the powdered nutritional product and a circumferential lid flange surrounding the central portion and extending towards said connection portion, a radially innermost perimeter of said lid flange and a radially outermost perimeter of said first flange being mutually adapted to directly engage each other to allow said lid to close in a sealing manner around said first flange of said connection portion, said lid being connected to said connection portion via an integrated hinge which has a connection part connecting to a lower end of said lid flange, the lower end being directly adjacent to said upper wall when said lid is closed, and said lid is provided with a lip for opening the lid, which lip is provided at said lower end of said lid flange, and wherein the circumferential lid flange defines a cylindrical space, the circumferential lid flange defines an outermost portion of the lid, and the central portion comprises a recessed dome, located in an interior of the circumferential lid flange, defined by said cylindrical space and having a highest point at a centre of the lid.

2. The container assembly of claim 1, wherein said access opening has an area of at least about 50 $cm^2$ to about 200 $cm^2$.

3. The container assembly of claim 1, wherein said stacking provisions on said connection portion comprise cams, and the circumferential wall of the container part extends downwards beyond the bottom wall and is sized to locate around an outside of the cams of a similar container assembly.

4. The container assembly according to claim 3, wherein said cams are positioned at corners of a rectangle which are provided around said lid when sealing said access opening.

5. The container assembly according to claim 3, wherein the height of said cams is at least the height of said lid when sealing said access opening.

6. The container assembly according to claim 1, wherein said connection portion comprises a circumferential rim for receiving an upper edge of a side wall of said container part in a groove, the inner perimeter of said rim being complementary to the perimeter enclosing said stacking provisions of said lid part for providing complementary stacking means for stacking a series of lid parts.

7. The container assembly according to claim 1, wherein said lid part is substantially made from a thermoplastic material and comprising a connection portion for connection to a rim of a container part and a lid which is pivotably connected to said connection portion, said connection portion comprising an access opening and a circumferential first flange surrounding said access opening, said lid comprising a circumferential lid flange extending towards said connection portion, perimeters of said lid flange and of first flange mutually adapted to allow said lid to close in a sealing manner on said first flange of said connection portion, and an area of said access opening is at least about 50 $cm^2$.

8. The container assembly according to claim 1, wherein said lip is provided with an end rim which extends to a periphery of the connection portion.

9. The container assembly according to claim 8, wherein said connection portion is provided with a tamper evident strip which blocks the lip.

10. The container assembly according to claim 9, wherein said tamper evident strip has holes and blocking ends of said lip extend radially through said holes to provide a visible indication.

11. A lid part for a container assembly, said lid part comprising:

a connection portion for connection to a rim of a circumferential wall; and a lid which is pivotably connected to said connection portion, said connection portion comprising an upper wall provided with an access opening which can be sealed with said lid, and said connection portion is provided with stacking provisions which are provided around said access opening, wherein said lid part has a weight of about 5-500 gr, an area of said access opening is at least 50% of the area of the connection portion, said access opening is surrounded by a circumferential first flange and said lid comprises a central portion having an underside including a clamp for holding a metering scoop for a powdered product and a circumferential lid flange surrounding the central portion and extending towards said connection portion, a radially innermost perimeter of said lid flange and a radially outermost perimeter of said first flange being mutually adapted to directly engage each other to allow said lid to close in a sealing manner around said first flange of said connection portion, said lid being connected to said connection portion via an integrated hinge which has a connection part connecting to a lower end of said lid flange, the lower end being directly adjacent to said upper wall when said lid is closed, and said lid is provided with a lip for opening the lid, which lip is provided at said lower end of said lid flange, and wherein the circumferential lid flange defines a cylindrical space, the circumferential lid flange defines an outermost portion of the lid, and the central portion comprises a recessed dome, located in an interior of the circumferential lid flange, defined by said cylindrical space and having a highest point at a centre of the lid.

12. The lid part of claim 11, wherein said lid part is substantially made from a thermoplastic material.

13. The lid part of claim 11, wherein an area of said access opening is at least about 50 $cm^2$.

14. A package comprising the container assembly of claim 1 and further comprising a quantity of the powdered nutritional product within the container part.

15. The container assembly of claim 2, wherein said stacking provisions on said connection portion comprise cams.

16. The container assembly according to claim 4, wherein the height of said cams is at least the height of said lid when sealing said access opening.

17. The lid part of claim 12, wherein an area of said access opening is at least about 50 $cm^2$.

18. The container assembly according to claim 1, further comprising a metering scoop, the metering scoop being engaged by the clamp at the underside of the lid.

19. The lid part according to claim 11, further comprising a metering scoop, the metering scoop being engaged by the clamp at the underside of the lid.

20. The package according to claim 14, further comprising a sealing foil attached to the inner surface of the circumferential wall of the container part below the rim.

21. The container assembly of claim 1, wherein said lid part has a weight of between 5 g and 100 g.

22. A lid part for a container assembly, said lid part comprising:

a connection portion for connection to a circumferential wall of a container and a lid, being pivotably connected to said connection portion, said connection portion comprising an upper wall provided with an access opening which can be sealed by said lid, said access opening being surrounded by an upstanding circumferential first flange and said lid comprises a central portion and a circumferential lid flange surrounding the central portion and extending towards said connection portion, wherein a radially innermost perimeter of said lid flange and a radially outermost perimeter of said first flange are sized to engage each other to allow said lid flange to close in a sealing manner around an outside of said first flange, and wherein the circumferential lid flange defines a cylindrical space, the circumferential lid flange defines an outermost portion of the lid, and the central portion comprises a recessed dome, located in an interior of the circumferential lid flange, defined by said cylindrical space and having a highest point at a centre of the lid.

23. The lid part of claim 22, wherein the highest point of the recessed dome extends to a position that is level with an uppermost point of the lid flange.

24. The lid part of claim 23, wherein the lid flange extends downwards to a rim and the recessed dome extends downwards to a lowest position that is level with the rim of the lid flange.

25. The lid part of claim 22, wherein the cylindrical space is an oval cylindrical space.

* * * * *